US007017511B2

(12) United States Patent
Fisher et al.

(10) Patent No.: US 7,017,511 B2
(45) Date of Patent: Mar. 28, 2006

(54) VEHICLE FLAG HOLDER HAVING A BROKER STAFF EJECTOR PIN

(76) Inventors: Kevin B. Fisher, 353 E. Ocampo La., Elkridge, UT (US) 84651; Preston K. Fisher, 323 E. Center St., Lindon, UT (US) 84042

( * ) Notice: Subject to any disclaimer, the term of this patent is extended or adjusted under 35 U.S.C. 154(b) by 124 days.

(21) Appl. No.: 10/831,604

(22) Filed: Apr. 22, 2004

(65) Prior Publication Data

US 2005/0241565 A1 Nov. 3, 2005

(51) Int. Cl.
*G09F 17/00* (2006.01)

(52) U.S. Cl. ..... 116/173; 116/28 R; 248/511

(58) Field of Classification Search ..... 116/173, 116/28 R; 40/591; 403/109.1, 109.4; 248/511, 248/519

See application file for complete search history.

(56) References Cited

U.S. PATENT DOCUMENTS

| | | | | | |
|---|---|---|---|---|---|
| 416,901 | A * | 12/1889 | Clark | 116/173 |
| 504,987 | A * | 9/1893 | Marum | 116/173 |
| 2,684,245 | A * | 7/1954 | Jacoby | 116/173 |
| 2,693,358 | A * | 11/1954 | Dawson, Jr. | 248/519 |
| 2,983,438 | A | 5/1961 | Brockman | |
| 3,082,778 | A * | 3/1963 | Cole | 248/511 |
| 3,760,441 | A * | 9/1973 | Handelman | 116/173 |
| 3,825,214 | A * | 7/1974 | Ciolfi | 403/112 |
| 3,864,048 | A * | 2/1975 | Parker | 403/108 |
| 3,946,699 | A * | 3/1976 | Mirshak | 116/173 |
| 4,944,656 | A * | 7/1990 | Feng et al. | 116/173 |
| D340,676 | S | 10/1993 | Gallagher | |
| 5,727,497 | A * | 3/1998 | Nichols, Jr. | 116/173 |
| D427,108 | S | 6/2000 | Fisher et al. | |
| 6,557,483 | B1 * | 5/2003 | Nathan | 116/173 |
| D475,677 | S | 6/2003 | Zucker | |
| 6,840,650 | B1 * | 1/2005 | Parsons et al. | 362/196 |

* cited by examiner

*Primary Examiner*—Richard Smith
*Assistant Examiner*—Travis Reis
(74) *Attorney, Agent, or Firm*—Angus C. Fox, III

(57) ABSTRACT

A flag holder for vehicles—such as motorcycles and all-terrain vehicles—mounts on a generally horizontal panel having a bolt hole stamped, punched or drilled therein. For a preferred embodiment of the invention, the flag holder includes a cylindrical main body having an axially-aligned cylindrical aperture for receiving the staff of a flag. The holder also includes a hollow threaded retaining fastener that is coaxial with the cylindrical aperture. A staff ejector pin, retained within the hollow threaded retaining fastener, may be employed to eject a broken end of the flag staff. Two alternative embodiments are provided. The first utilizes a threaded main body and a hollow retainer bolt. The second utilizes a threaded hollow stud and a nut.

20 Claims, 5 Drawing Sheets

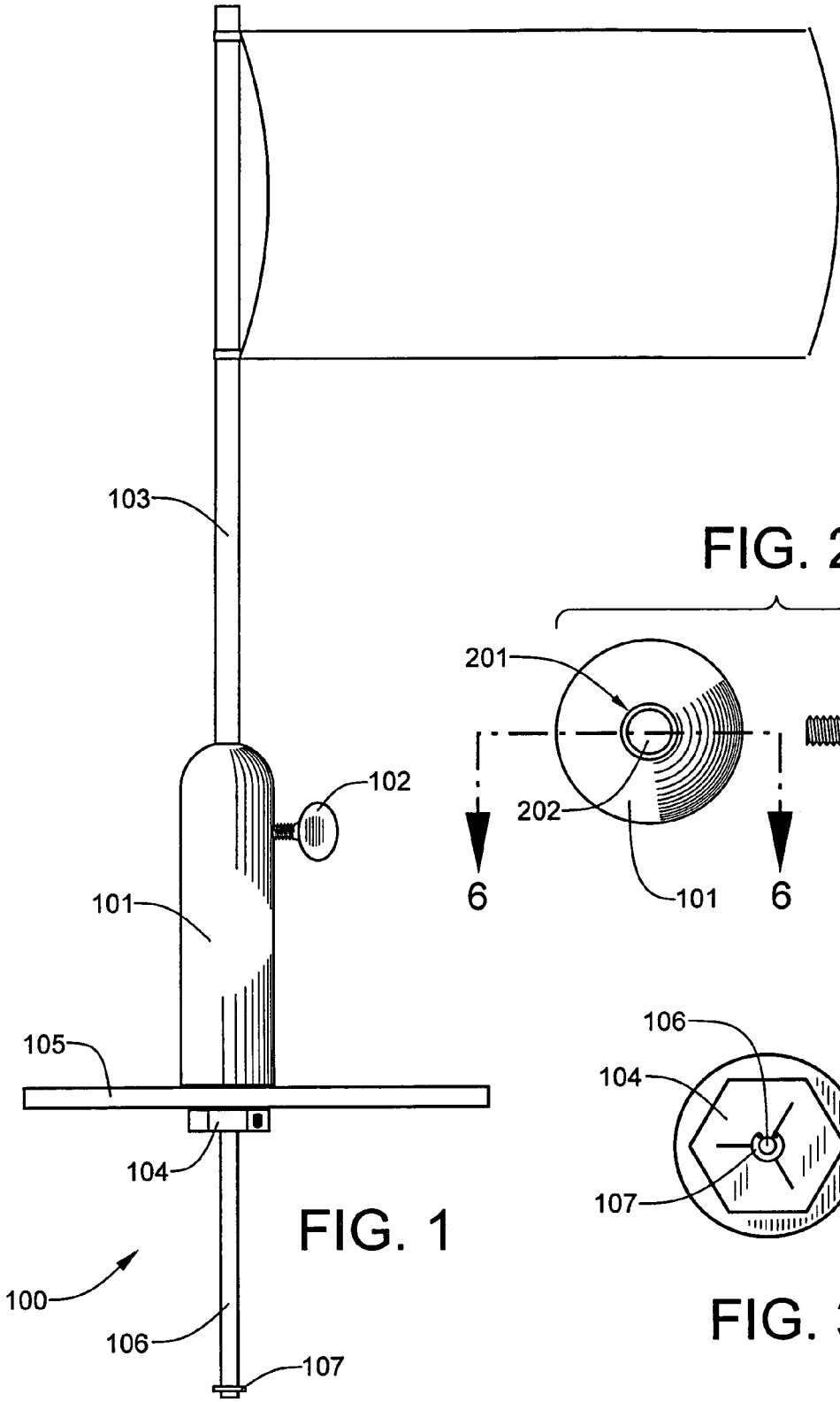
FIG. 1
FIG. 2
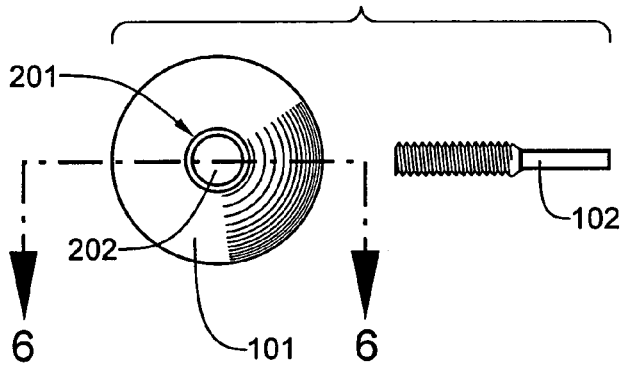
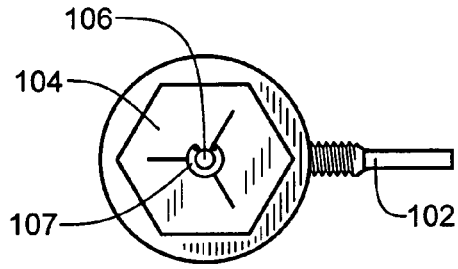
FIG. 3

VEHICLE FLAG HOLDER HAVING A BROKER STAFF EJECTOR PIN

BACKGROUND OF THE INVENTION

1. Field of the Invention

This invention relates to holders for flags, pennants, logos and indicia and, more particularly, to flag holders mountable on all-terrain vehicles and motorcycles.

2. Description of the Prior Art

Safety flags are typically required to be mounted on motorcycles and all-terrain vehicles when used off-road on government property. The safety flags announce the position of the vehicle before the vehicle or rider is visible when climbing a berm. Such a flag holder is disclosed in U.S. Pat. No. Des. 427,108 to Kevin B. Fisher, et al. As off-road vehicles—particularly motorcycles—are laid down or crashed somewhat frequently, the flag pole is subject to frequent breakage. Removing the anchored end of the flag pole from the holder may be somewhat difficult, especially if the break occurs just inside the holder.

What is needed is a flag holder which provides a mechanism to quickly remove the broken anchored end of the flag pole, without the use of tools and without removing the holder from the vehicle.

SUMMARY OF THE INVENTION

The present invention includes a flag holder for vehicles—such as motorcycles and all-terrain vehicles—which mounts on a generally horizontal panel having a bolt hole stamped, punched or drilled therein. For a preferred embodiment of the invention, the flag holder includes a cylindrical main body having an axially-aligned cylindrical aperture for receiving the staff, or pole, of a flag. The holder also includes a hollow threaded retaining fastener that is coaxial with the cylindrical aperture. A staff ejector pin, retained within the hollow threaded retaining fastener, may be employed to eject a broken end of the flag staff. Such a feature is particularly advantageous when the staff breaks even with or below the opening of the cylindrical aperture. Two alternative embodiments are provided. The first utilizes a threaded main body and a hollow retainer bolt. The second utilizes an externally-threaded hollow stud and a nut.

BRIEF DESCRIPTION OF THE DRAWINGS

FIG. 1 is a side elevational view of a first embodiment flag holder, showing it mounted on a horizontal piece of sheet metal and holding a flag;

FIG. 2 is a top plan view of the first embodiment flag holder;

FIG. 3 is a bottom plan view of the first embodiment flag holder;

DETAILED DESCRIPTION OF THE INVENTION

Figure 4:
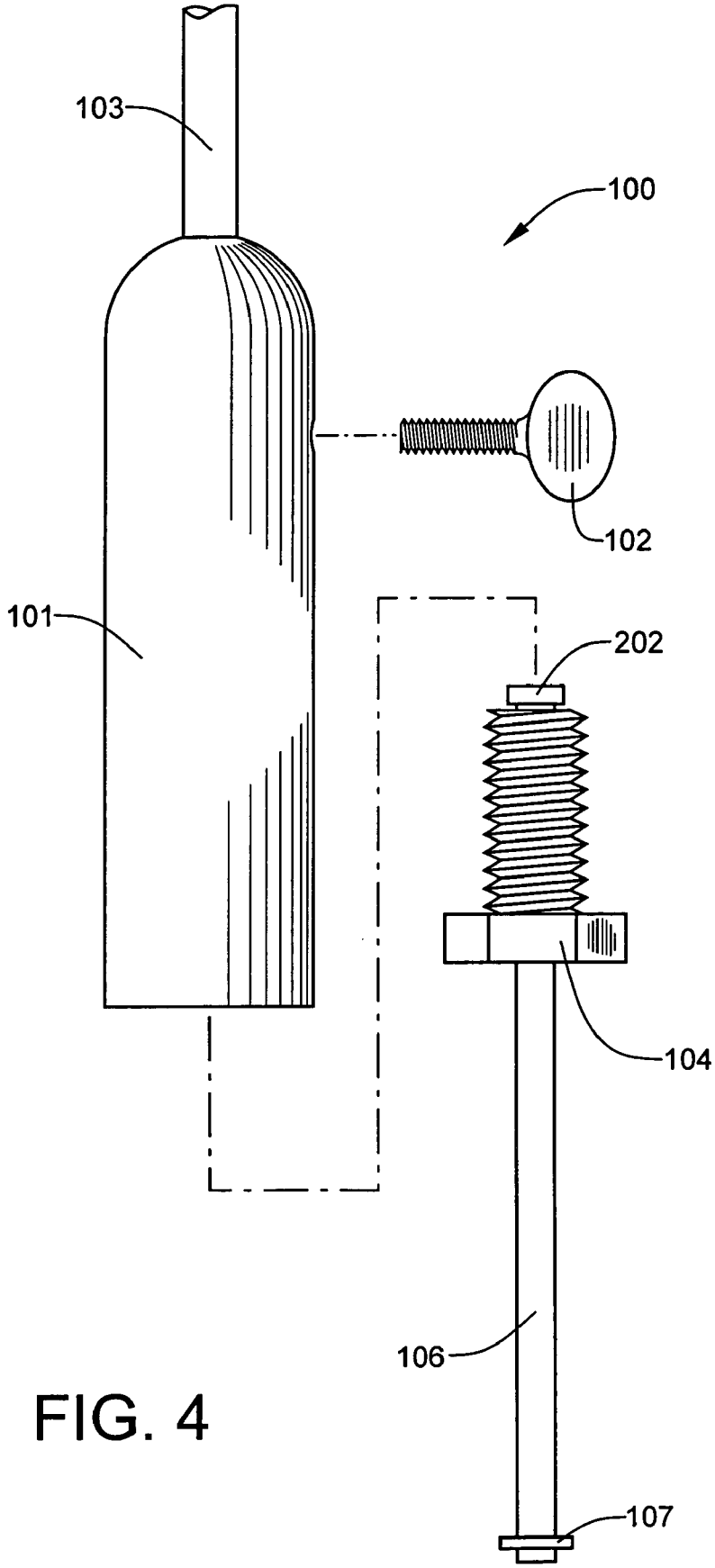
FIG. 4 is an exploded view of the first embodiment flag holder.

The invention will now be described with reference to the included drawing figures. It is to be understood that the drawings are not necessarily drawn to scale, and that they are intended to be merely illustrative.

Referring now to FIG. 1, a first embodiment flag holder 100 includes a cylindrical main body 101, a set screw 102 for securing a flag staff 103, a hollow bolt 104 for securing the flag holder 100 on a flat panel 105, and an ejector pin 106, the lower end of which is secured within the hollow bolt 104 by a spring retainer clip 107.

Referring now to FIG. 2, the first embodiment flag holder 100 is seen from the top. The cylindrical main body 101 has an axially-aligned cylindrical aperture 201 for receiving a flag staff (103 of FIG. 1). Within the cylindrical aperture 201 is seen the head 202 of the ejector pin 106. The head 202 retains the upper end of the ejector pin within the hollow bolt 104. The set screw 102 is shown removed from the cylindrical main body 101.

Referring now to FIG. 3, the first embodiment flag holder 100 is seen from the bottom. The cylindrical main body 101, the hollow bolt 104, the ejector pin 106, the spring retaining clip 107, and the set screw 102 are seen in this view.

Referring now to FIG. 4, this exploded view of the first embodiment flag holder 100 completely shows the hollow bolt 104 and the ejector pin 106 retained therein by the ejector pin head 202 and the spring retainer clip 107.

Figure 5:
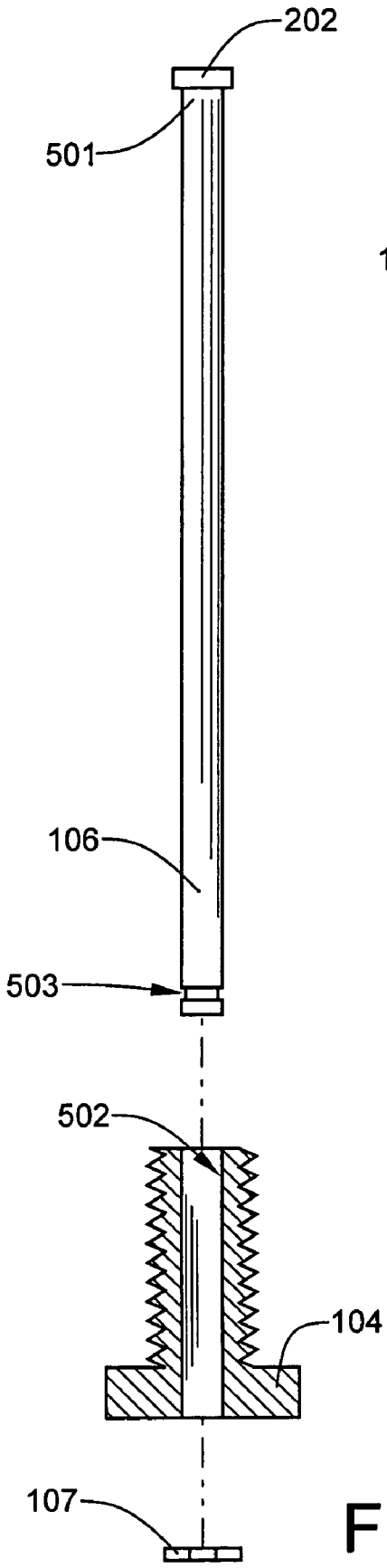
FIG. 5 is a cross-sectional view of the hollow retaining fastener, the ejector pin, and an external snap ring.

Referring now to FIG. 5, the cut-away view of the first embodiment flag holder 100 shows the complete ejector pin 106, with the head 202 affixed to the upper end 501 thereof. Also shown is the axial aperture 502 of the hollow bolt 104, through which the ejector pin 106 is retained by its head 202 and the spring retainer clip 107. An annular groove 503, into which the spring retainer clip 107 fits is visible in this view.

Figure 6:
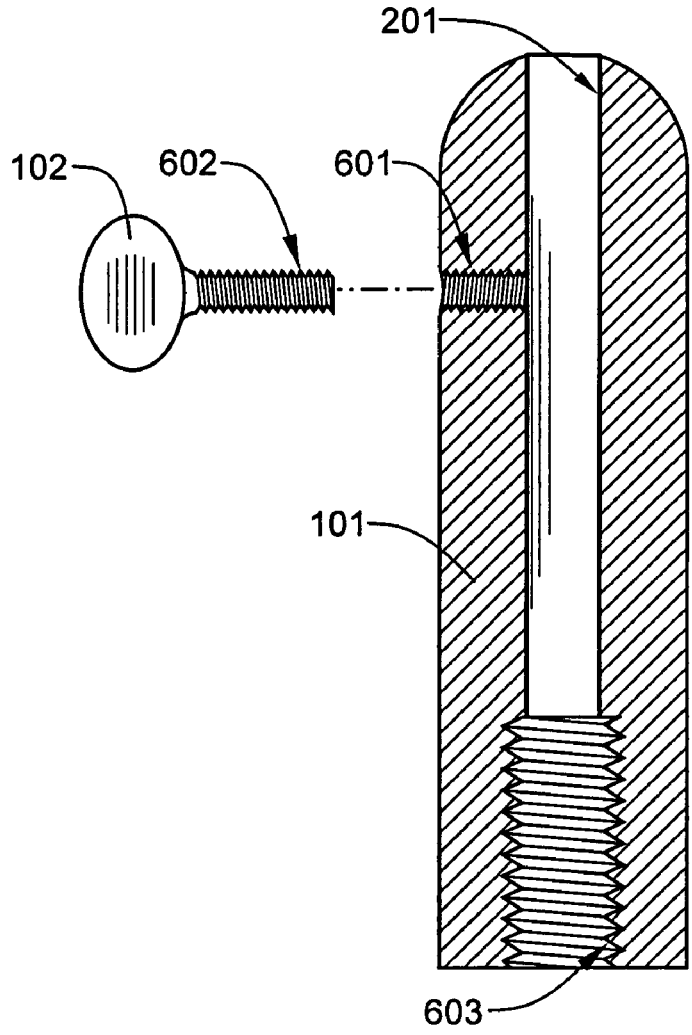
FIG. 6 is a side elevational view of the main body of the first embodiment flag holder.

Referring now to FIG. 6, the axially-aligned cylindrical aperture 201 of the cylindrical main body 101 is visible in this view. It will be noted that a bottom portion 601 of the cylindrical aperture 201 is threaded to receive the hollow bolt 104. Also visible is a threaded aperture 601 perpendicular to the cylindrical aperture 201, which threadably receives the threaded shaft 602 of the set screw 102. The threaded aperture 601 enters the cylindrical aperture, thereby permitting the set screw 102 to be tightened against a flag staff that is inserted in the cylindrical aperture 201.

Figure 7:
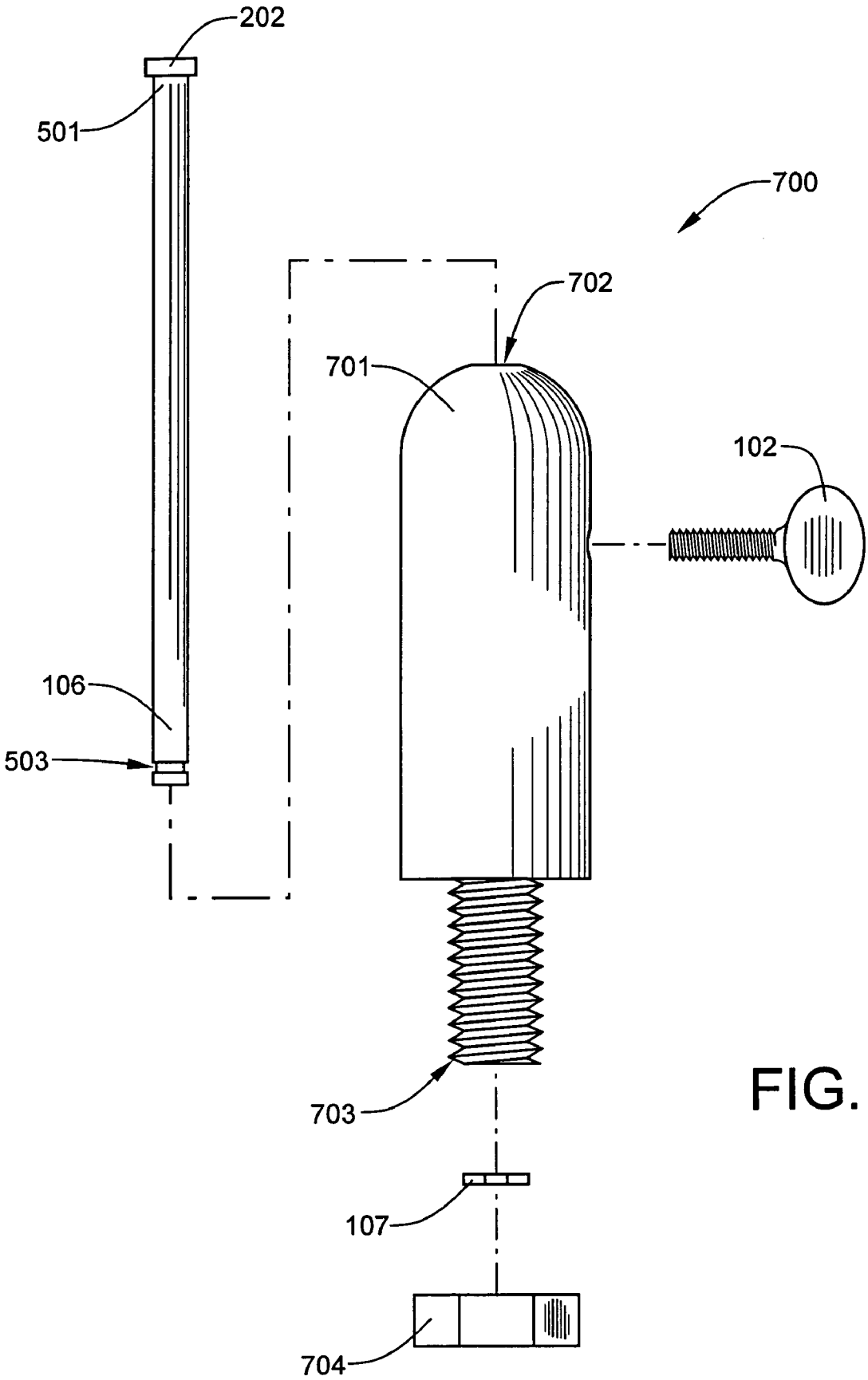
FIG. 7 is an exploded view of a second embodiment flag holder.

Referring now to FIG. 7, a second embodiment flag holder 700 is similar to the first embodiment flag holder 100, but with the following differences: The cylindrical main body 701 has been shortened, as compared with the main body 101 of the first embodiment flag holder, because the hollow bolt 104 has been replaced with a hollow threaded stud 703, which protrudes from the bottom of the shortened cylindrical body 701. A cylindrical aperture 702 receives the staff of a flag. A standard hex nut 704 is employed to secure the second embodiment flag holder 700 to a flat panel (not shown).

Figure 8:
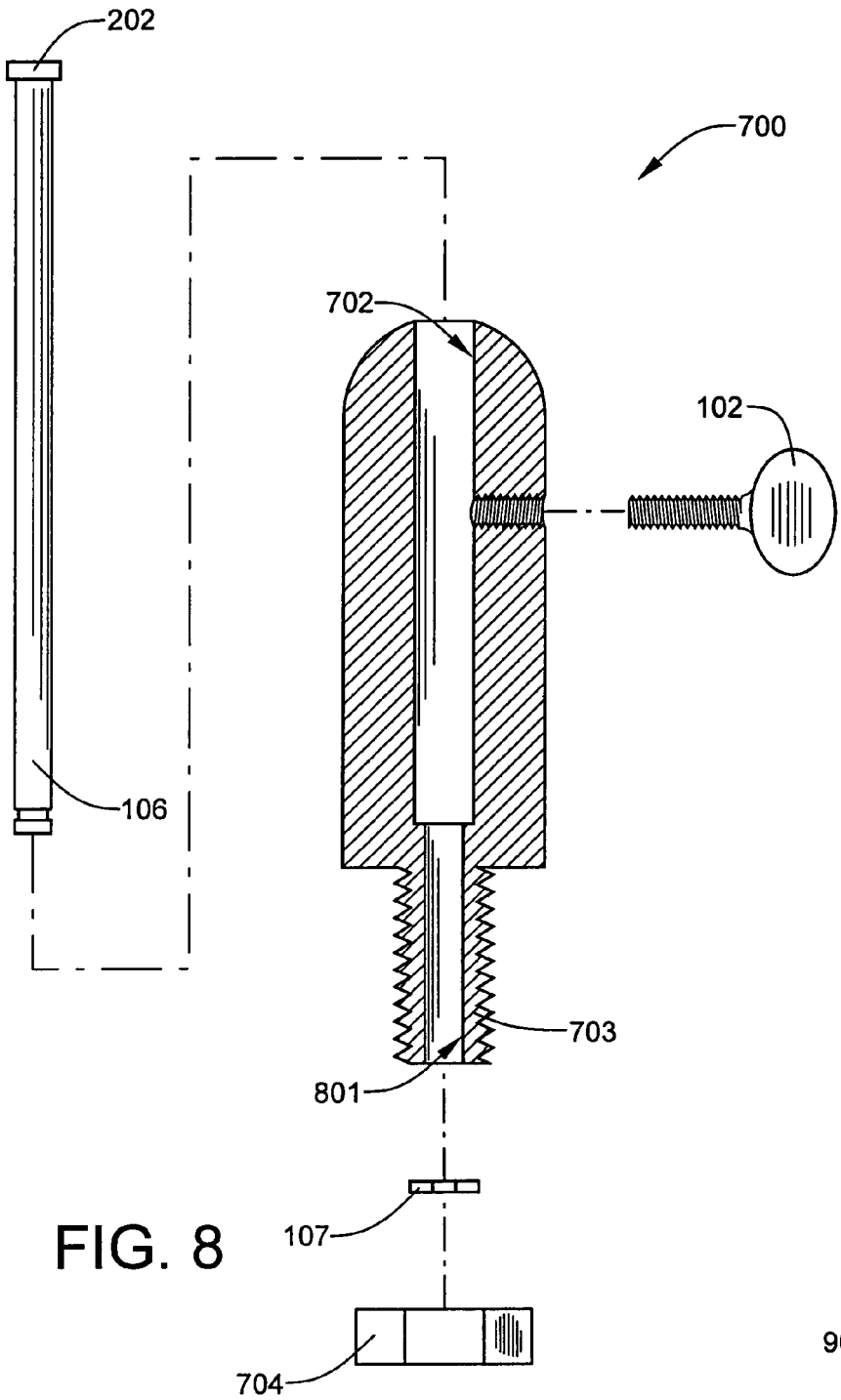
FIG. 8 is a cross-sectional exploded view of the second embodiment flag holder.

Referring now to FIG. 8, the cross-sectional view through the central axis of the second embodiment flag holder 700 shows how an ejector pin aperture 801 through the hollow threaded stud 703 is of smaller diameter than the cylindrical aperture 702.

Figure 9:
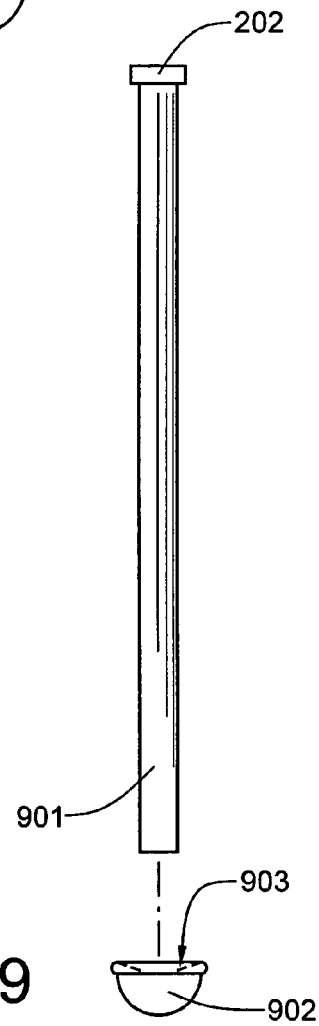
FIG. 9 is a side elevational view of an alternative embodiment staff ejector pin.

Referring now to FIG. 9, an alternative embodiment for the staff ejector pin 901 dispenses with the annular groove 503 and employs a press-on retainer cap 902 which has a plurality of spring barbs 903 which grip the lower end of the ejector pin when the press-on retainer cap 902 is forced thereon.

Although only several embodiments of the invention has been shown and described, it will be obvious to those having ordinary skill in the art that changes and modifications may be made thereto without departing from the scope and the spirit of the invention as hereinafter claimed.

What is claimed is:

1. A flag holder for vehicles comprising:

a main body attachable to a vehicle having a generally vertical aperture therein for receiving a flag staff; and a staff ejector pin retained and slideably movable within said vertical aperture, such that upward movement of the staff ejector pin will eject any portion of the flag staff which may break and remain within the vertical aperture.

2. The flag holder of claim 1, wherein said main body also has a generally horizontal threaded aperture therein, which communicates with said vertical aperture; and said flag holder further comprises a finger-tightenable set screw for threadably engaging the threaded aperture, said set screw having an end which bears against the flag staff in order to anchor the latter within the vertical aperture.

3. The flag holder of claim 1, wherein a lower portion of the vertical aperture is threaded and said flag holder further comprises a hollow, threaded bolt, which threadably engages said threaded lower portion and secures the flag holder to the vehicle, said staff ejector pin passing through said hollow, threaded bolt.

4. The flag holder of claim 1, wherein said main body further comprises a hollow, threaded stud that is unitary with said main body, said staff ejector pin passing through said hollow, threaded stud, said flag holder further comprising a threaded nut that engages said hollow threaded stud to secure the flag holder to the vehicle.

5. The flag holder of claim 1, wherein said main body is generally cylindrical in shape, and said generally vertical aperture is both cylindrical and coaxial with said main body.

6. The flag holder of claim 1, wherein said hollow threaded anchoring fastener is a hollow, externally-threaded stud and a threaded nut which engages said hollow threaded stud.

7. The flag holder of claim 1, wherein said staff ejector pin comprises:

a cylindrical shaft having a head at an upper end and an annular groove at a lower end thereof; and a spring retainer clip which engages the annular groove; and wherein said staff ejector pin is retained within said vertical aperture by said head and said spring retainer clip.

8. The flag holder of claim 1, wherein said staff ejector pin comprises:

a cylindrical shaft having a head at an upper end thereof; and a press-on spring retainer cap which fits over a lower end of said cylindrical shaft; and wherein said staff ejector pin is retained within said vertical aperture by said head and said press-on retainer cap.

9. The flag holder of claim 8, wherein said staff ejector pin is installed within the hollow, externally-threaded stud by passing it through said generally vertical aperture, then through the hollow, externally-threaded stud, said staff ejector pin having a head on an upper end thereof which prevents it from passing downwardly through said externally-threaded stud, said staff ejector pin also having a spring retainer selected from the group consisting of clips and caps which attaches to a lower end of said staff ejector pin, thereby preventing said staff ejector pin from passing upwardly through said externally-threaded stud.

10. A flag holder for vehicles for mounting on a generally horizontal panel having a mounting aperture therein, said flag holder comprising:

a main body having a generally vertically-oriented cylindrical aperture therein for receiving a flag staff, and a generally horizontal threaded aperture therein;

a set screw for threadably engaging the threaded aperture, said set screw having an end which bears against the flag staff in order to anchor the latter within the cylindrical aperture;

a hollow threaded anchoring fastener for inserting through the mounting aperture and securing the flag holder to the generally horizontal panel; and a staff ejector pin retained and slideably movable within the hollow threaded retaining fastener, said staff ejector pin extending into said cylindrical aperture, such that upward movement thereof will eject any portion of the flag staff which may break and remain within the cylindrical aperture.

11. The flag holder of claim 10, wherein said main body is generally cylindrical in shape, and said generally vertically-oriented cylindrical aperture is coaxial with said main body.

12. The flag holder of claim 10, wherein said hollow threaded anchoring fastener is a hollow bolt, and a bottom portion of said generally vertically-oriented cylindrical aperture is threaded to threadably receive said hollow bolt.

13. The flag holder of claim 10, wherein said hollow threaded anchoring fastener comprises a hollow, externally-threaded stud and a threaded nut which engages said hollow threaded stud.

14. The flag holder of claim 10, wherein said staff ejector pin comprises:

a cylindrical shaft having a head at an upper end and an annular groove at a lower end thereof; and a spring retainer clip which engages the annular groove; and wherein said staff ejector pin is retained within said hollow threaded fastener by said head and said spring retainer clip.

15. The flag holder of claim 10, wherein said set screw has a finger-tightenable head.

16. The flag holder of claim 15, wherein said staff ejector pin is installed within the hollow, externally-threaded stud by passing it through the cylindrical aperture, then through the hollow, externally-threaded stud, said staff ejector pin having a head on an upper end thereof which prevents it from passing through said externally-threaded stud, said staff ejector pin also having a groove on a lower end there of which engages a spring retainer clip, said spring retainer clip preventing said the head of said staff ejector pin remaining within the cylindrical aperture, and said spring retainer clip, once installed on said staff ejector pin, preventing the latter from being removed from said hollow, externally-threaded stud.

17. A flag holder for vehicles comprising:

a main body having a generally vertical cylindrical aperture therein for receiving a flag staff, said axial cylindrical aperture being open at both ends and having a threaded lower portion;

a hollow threaded mounting bolt, which engages said threaded lower portion, for anchoring said main body on a generally horizontal panel having a mounting aperture therein; and a staff ejector pin retained and slideably movable within the hollow threaded mounting bolt, said staff ejector pin extending into said cylindrical aperture when said mounting bolt is installed within said main body, such that upward movement of the staff ejector pin will eject any portion of the flag staff which may break and remain within the cylindrical aperture.

18. The flag holder of claim 17, wherein said staff ejector pin comprises:

a cylindrical shaft having a head at an upper end and an annular groove at a lower end thereof; and a spring retainer clip which engages the annular groove; and wherein said staff ejector pin is retained within said hollow threaded bolt by said head and said spring retainer clip.

19. The flag holder of claim 17, wherein said staff ejector pin comprises:

a cylindrical shaft having a head at an upper end thereof; and a press-on spring retainer cap which fits over a lower end of said cylindrical shaft; and wherein said staff ejector pin is retained within said vertical aperture by said head and said press-on retainer cap.

20. The flag holder of claim 17, wherein said main body also includes a generally horizontal threaded aperture therein, which communicates with said axial cylindrical aperture; and said flag holder further comprises a finger-tightenable set screw for threadably engaging the threaded aperture, said set screw having an end which bears against the flag staff in order to anchor the latter within the cylindrical aperture.

* * * * *